United States Patent [19]

Smith

[11] 3,958,280

[45] May 25, 1976

[54] FLUSHING VALVE

[76] Inventor: Bobbie R. Smith, 14000 Tahiti Way, No. P-37, Marina Del Rey, Calif. 90291

[22] Filed: May 19, 1975

[21] Appl. No.: 578,478

[52] U.S. Cl. ..... 4/52; 4/53; 4/56; 4/65; 4/67 R; 4/75

[51] Int. Cl.[2] ..... E03D 1/34

[58] Field of Search ..... 4/75, 52, 57 R, 67 R, 4/57 P, 67 A, 61, DIG. 1, 34, 37, 56, 53

[56] References Cited

UNITED STATES PATENTS

| | | | |
|---|---|---|---|
| 1,103,550 | 7/1914 | Stevens | 4/DIG. 1 |
| 1,956,087 | 4/1934 | Tracy | 4/75 |
| 2,531,475 | 11/1950 | Scerolen | 4/75 |
| 2,689,352 | 9/1954 | Pegler | 4/52 |
| 2,904,794 | 9/1959 | Goldtrap | 4/57 R |
| 2,949,614 | 8/1960 | Eddowes | 4/57 R |
| 2,988,751 | 6/1961 | Rutherford | 4/56 |
| 3,117,323 | 1/1964 | Corsan | 4/67 R |

*Primary Examiner*—Henry K. Artis
*Attorney, Agent, or Firm*—Singer & Singer

[57] ABSTRACT

An improved flushing valve for inter-connecting a water closet with a waste dispensing bowl for preventing overflow in the event of a line stoppage. The valve is opened in the ordinary manner and held open by the action of fluid flowing through the valve onto a floatable member having a positive buoyancy that maintains the valve in an open condition in the presence of fluid flow. In the absence of a fluid flow, the valve is allowed to close. In the presence of a line stoppage, overflow fluid will tend to back up causing the floatable member having a positive buoyancy to release the valve which is allowed to close thereby preventing discharge of any further fluid from the water closet. All attempts to operate the water valve will fail as long as the floatable member is held in a floatable condition by the overflow fluid.

8 Claims, 4 Drawing Figures

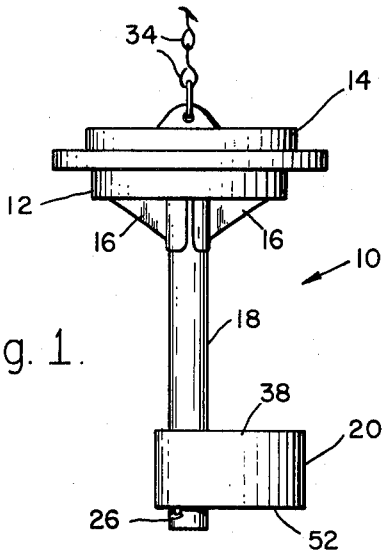
Fig. 1.
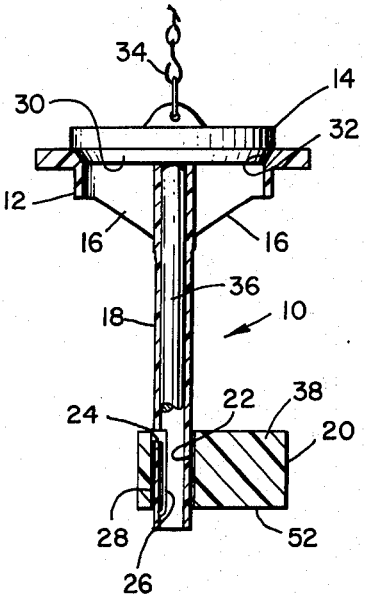
Fig. 2.
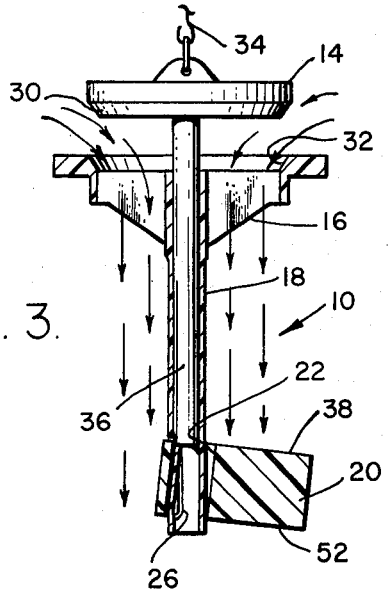
Fig. 3.
Fig. 4.
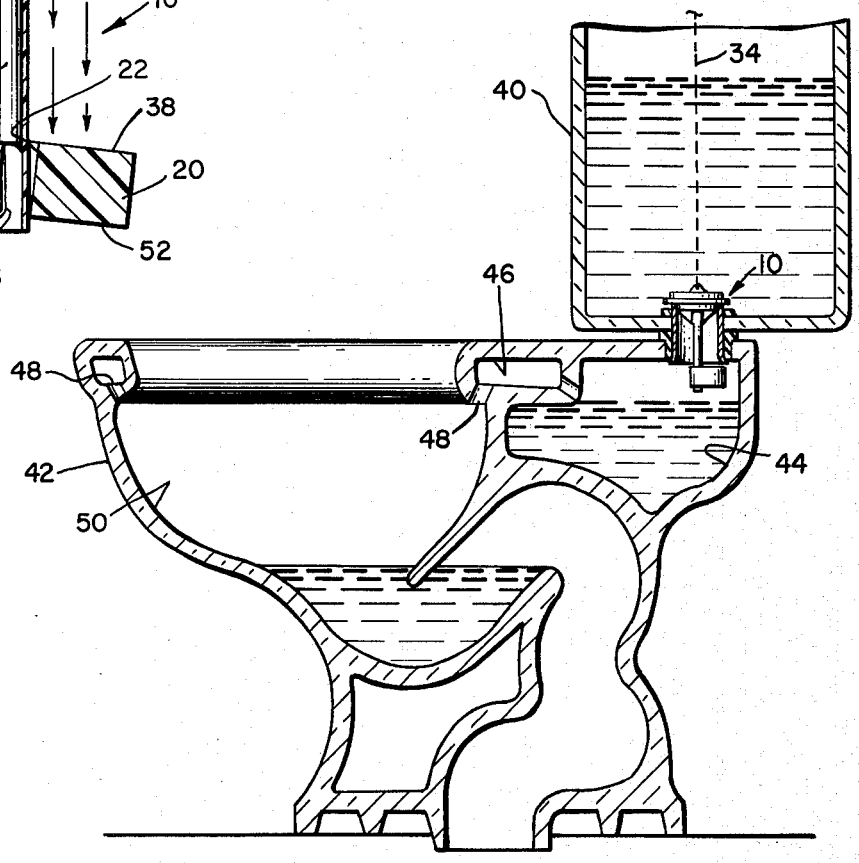

FLUSHING VALVE

This invention relates to an improved flushing valve and more particularly to a valve that depends on the flow of water through the valve to maintain the valve in an open condition. In the presence of an overflow condition, the valve will close, preventing further fluid flow from the water closet.

In the plumbing art as practiced today the conventional bathroom installation comprises a toilet bowl and a water closet usually situated to the rear of the toilet bowl and inter-connected so as to allow the operator to turn a valve and cause water located within the water closet to flush through the toilet bowl and eventually to an external sewer or septic tank arrangement.

In the typical situation the flushing valve interconnecting the water closet and the toilet bowl is pulled open by a suitable linked chain and is held open by the buoyant action of the valve which is not allowed to close until the water reaches a level in the water closet sufficient to cause the valve to nest upon the valve seat. The rising water pressure within the water closet keeps the valve closed and in a nesting relation with the valve seat until the chain is again pulled to unseat the valve.

The prior art discloses many and varied valves for controlling the water flow from the water closet.

In the present invention the disclosed improved flushing valve is made responsive to a stoppage in the toilet bowl that could result in an overflow condition should water from the water closet be allowed to continue to flow.

The prior art has recognized the problem of overflow resulting from a line stoppage but unfortunately as of this date there is no convenient device that can be added to an existing bowl and water closet arrangement to prevent the overflow in the event of a line stoppage.

In U.S. Pat. No. 2,778,029, issued to W. G. Young on Jan. 22, 1957, there is disclosed a "non-overflow water closet" for eliminating overflow conditions. The Young patent recognizes that the water level in the bowl in the event of a line stoppage will rise as a result of water flowing from the water closet into the toilet bowl. Recognizing that the main discharge is clogged there is disclosed a toilet bowl having an auxiliary trap way in addition to the main trap way conventionally used in modern toilet bowls. In the event of a stoppage in the main trap way the rising water will simply flow through the auxiliary trap way and into the sewer line.

The prior art solution as evidenced by the Young patent requires that all conventional toilet bowls be replaced with the new toilet bowl having the auxiliary passages described by Young. In view of the complete replacement required, it is quite evident from the volume and expense of replacing the complete toilet bowl that the solution shown by the prior art is not one that is readily available for exploitation.

In any event the prior art does not recognize a stoppage in the line below the toilet bowl which would thereby cause auxiliary trap lines as well as the main trap lines to back up and cause an overflow condition.

The present invention does not contemplate replacing existing toilet bowls or water closets but rather replaces only the flushing valve normally used to interconnect the water closet with the toilet bowl. The principle of operation resides in the fact that in the presence of an overflow condition a floatable member having a positive buoyancy senses the rising water level and immediately closes the flushing valve thereby preventing additional water from the water closet to pass through into the toilet bowl.

In the present invention the improved flushing valve comprises a valve having a centrally located valve guide attached below the valve seat and in the normal flow pattern of the liquid. In the preferred embodiment the valve seat is circular and is centrally attached to the valve guide by means of a plurality of vanes. Typically three vanes are used in order to reduce the pressure drop of the fluid passing through the valve seat.

The valve contains a centrally located stem. The stem is adapted to fit within a valve guide attached to the valve seat and in the normal fashion will allow the valve face to nest with the valve seat so as to close the valve and prevent the flow of fluid. A floatable member is attached to a flexible resilient portion of the valve guide wall which is attached to the valve seat and is used to interfere with the movement of the valve stem within the valve guide at a discrete position, thereby preventing the valve face from nesting with the valve seat. The float member is located in the flow pattern of the fluid passing through the valve seat. The fluid causes a pressure on the floatable member which flexes the resilient portion of the valve guide thereby preventing the valve from closing. This condition continues as long as fluid is flowing through the valve seat and exerting a pressure on the floatable member.

The floatable member has a positive buoyancy in the fluid being controlled. In the event of a line stoppage the fluid in the toilet bowl will rise, contacting the floatable member, thereby generating a force on the floatable member in a direction opposite to that caused by the fluid flowing through the valve seat. The rising water exerts a force on the floatable member so as to stop the flexible resilient portion of the valve guide wall from interfering with the valve stem. The valve is allowed to close thereby preventing further flow of water from the water closet.

Further objects and advantages of the present invention will be made more apparent by referring now to the accompanying drawings wherein:

FIG. 1 is a side elevation view of the improved flushing valve;

FIG. 2 is a partial cross-section of the valve illustrated in FIG. 1;

FIG. 3 is a partial cross-section of the valve illustrated in FIG. 1 in the open position; and FIG. 4 is a cross-section of a toilet bowl and water closet containing the improved flushing valve.

Referring now to FIGS. 1 and 2 there is shown the improved flushing valve 10 comprising a valve body 12 and a valve 14.

Centrally located and attached to the valve body 12 by means of three equally located vanes 16 is a valve guide 18. The guide 18 is located below the valve body 12 and is located in the direction of the fluid flow when the valve 14 is open.

Located on the bottommost portion of the valve guide 18 is a floatable member 20 adapted to have a positive buoyancy in the fluid medium being controlled. The floatable member 20 has a cylindrical opening 22 having a diameter large enough to encompass the diameter of the valve guide 18.

In the preferred embodiment the wall portion 24 of the valve guide 18 is cut and otherwise weakened by longitudinal openings 26 to thereby make the wall portion 24 flexible and resilient to any change or movement.

The valve guide 18 is inserted into the opening 22 located within the floatable member 20. The flexible resilient portion 24 of the valve guide 18 is fixedly attached by suitable bonding material 28 to only one portion of the internal diameter of opening 22. In the normal configuration the wall portion 24 is thick enough and has sufficient resiliency to support and otherwise hold the floatable member 20 as more fully shown in connection with FIG. 2.

The valve 14 contains valve face 30 for mating with a valve seat 32 located on the valve body 12.

Located on the uppermost portion of the valve 14 is a chain 34 connected to the usual operating handle for controlling the flushing valve. Located on the centralmost portion of the valve 14 is a valve stem 36 having a diameter sufficient to penetrate within the internal diameter of valve guide 18 attached to the valve body 12.

A review of FIGS. 1 and 2 will show that the floatable member 20 is attached to the flexible resilient portion 24 on only one side of the opening 22. The bonding between the floatable member 20 and the flexible portion 24 occurs longitudinally on one side only in order to allow the floatable member 20 to twist and thereby flex the wall portion 24.

In the normal configuration the valve stem 36 is free to move within the internal diameter of the valve guide 18 without obstruction, however, should the floatable member 20 deflect or bend the wall portion 24 then the internal diameter of valve guide 18 will be restricted and the valve stem 36 will be prevented from allowing the valve 14 to close as is more fully illustrated in connection with FIG. 3.

In FIG. 3 there is shown the effect of exerting a pull on chain 34. The valve 14 has been pulled up a sufficient distance to allow the lower end of valve stem 36 to rise above the opening forming the wall portion 24. In this position the fluid held within the water closet is free to pass between the valve body 12 and the valve 14. The fluid flow, however, is caused to impact upon the uppermost surface 38 of the floatable member 20 thereby causing the floatable member to twist and thereby bend the resilient wall portion 24 so as to reduce the internal diameter of the valve guide 18.

The continued pressure of the falling liquid on surface 38 will cause the end of valve stem 36 to contact the wall portion 24 and prevent the valve 14 from closing. This will occur even though the operator has since removed tension from the chain 34 since it is now the water pressure flowing and hitting the surface 38 that keeps the valve 14 in an open condition. This condition will persist as long as fluid is flowing.

However, upon the emptying of the liquid from the water closet, the pressure on surface 38 will be removed and the inherent resiliency of the wall portion 24 will again straighten the floatable portion 20 as shown in connection with FIGS. 1 and 2 thereby allowing the valve stem 36 to move past the wall portion 24 and close the valve 14. The conventional action of the water closet will now allow the liquid level to rise to a predetermined height as set by the float mechanism generally associated with water closets.

The action just described will continue and repeat itself as long as the floatable member 20 is allowed to twist and bend the wall portion 24 so as to interfere with the movement of the valve stem 36.

Referring now to FIG. 4, there is shown a water closet 40 located and supported by a toilet bowl assembly 42. The flow of water from the water closet 40 is controlled by an improved flushing valve 10 of the type described in connection with FIGS. 1, 2 and 3.

In the conventional bowl, water passing through the closet 40 normally flows into a first chamber 44 where it flows into a second chamber 46 which feeds a plurality of openings 48 located along the periphery of the main bowl portion 50. The output from the main discharge of water from the first chamber 44 is fed through openings not shown directly into the bowl 50 to provide the flushing action.

In the event of a stoppage which could occur anywhere from the sewer line up to and including the bowl 50, water flowing from the water closet 40 through the valve 10 will cause chamber 44 to fill and eventually cause the bowl 50 to fill. As the water level in the first chamber 44 rises, the action of the water level on the floatable member 20 is such that the floatable member having a positive buoyancy is caused to float and to exert a force on the bottommost surface 52 thereby counteracting the force generated by the falling water on surface 38.

In other words, the effect of the buoyancy of the rising water on the floatable member 20 will counteract the force of the falling water through the valve body 12 on surface 38 thereby allowing the floatable member 20 to achieve a normal position as shown in connection with FIGS. 1 and 2. This action removes the impediment of the wall portion 24 against the valve stem 36 and allows the valve 14 to close thereby effectively sealing the valve face 30 against the valve seat 32 and stopping the flow of water from the water closet.

This condition will continue until the operator again pulls on the chain 34 in an attempt to open the valve 14. If the blockage condition has been cleared the valve 10 will operate in the conventional manner, however, should the blockage exist causing chamber 44 to be full, then pulling on chain 34 will initially raise the valve 14 which will immediately close again due to the buoyancy action against the floatable member 20.

The improved flushing valve 10 can be seen to react to an overflow condition regardless of whether the blockage is in the sewer line or in the bowl assembly itself. The stoppage of water is complete and absolute since further operation of the valve is prevented by the continued overflow condition. Removal of the overflow condition such as by clearing the stoppage allows the valve to be used in the conventional manner.

I claim:

1. A water closet flushing valve comprising:

a valve body having a valve seat and a centrally located valve guide located below said valve seat in the normal flow pattern, a valve for nesting with said valve seat and having a valve stem adapted to fit within said valve guide, and a floatable member attached to a flexible resilient portion of said valve guide wall for interfering with the movement of said valve stem, said float being located in said flow pattern whereby fluid flow through the valve seat contacts said floatable member which flexes the valve guide wall for interfering with the movement of the valve stem.

2. A valve according to claim 1 in which said valve seat is circular and centrally attached to said valve guide by a plurality of vanes located below said valve seat.

3. A valve according to claim 1 in which said valve is solid and said valve stem is fixedly attached to the central portion of said solid valve.

4. A valve according to claim 1 in which fluid flow contacting said floatable member flexes said valve guide wall for stopping said valve stem at a discrete position that prevents the valve from nesting with the valve seat.

5. A valve according to claim 1 in which said floatable member has a positive buoyancy in the fluid medium being controlled.

6. A valve according to claim 1 in which said floatable member has a cylindrical opening defining a cylinder that is off-set with respect to the center of said member for accepting said valve guide and in which a portion of said cylinder is fixedly attached to said flexible resilient portion of said valve guide.

7. A water closet flushing valve comprising:

a valve body having a valve seat and a centrally located valve guide located below said valve seat in the normal flow pattern, said valve body being circular and centrally attached to said valve guide by a plurality of vanes located below said valve seat, a valve for nesting with said valve seat and having a solid stem adapted to fit into said valve guide, said stem being solid and fixedly attached to the central portion of said solid valve, a floatable member attached to a flexible resilient portion of said valve guide wall for stopping said stem at a discrete position that prevents the valve from nesting with the valve seat, said floatable member being located in said flow pattern whereby fluid flow through the valve seat contacts said floatable member which flexes the valve guide wall for stopping said valve from closing, and said floatable member having a positive buoyancy in the fluid medium being controlled for floating in the fluid in the presence of a stoppage to prevent said flexible valve guide wall from stopping the closure of the valve thereby closing said valve to prevent further fluid flow.

8. In a water closet a valve adapted to close in the event of a stoppage comprising:

a valve body mounted in the lowermost portion of a water closet, said valve body having a centrally located hollow valve guide located below said valve body in the normal flow pattern, a valve for nesting with said valve seat and having a solid stem adapted to fit into said valve guide, said valve having a chain adapted to be connected to a control associated with said water closet for opening said valve, a floatable member attached to a flexible resilient portion of said valve guide wall for interfering with the movement of said stem, said floatable member being located in said flow pattern for flexing said valve guide wall and preventing said valve from closing during the flow of fluid, and said floatable portion having a positive buoyancy for floating in the fluid in the presence of a stoppage for preventing said flexible valve guide wall from interfering with the closure of said valve thereby closing said valve to prevent further fluid flow from the water closet in the event of a stoppage.

* * * * *